US010219970B2

(12) United States Patent
Weyergans

(10) Patent No.: US 10,219,970 B2
(45) Date of Patent: Mar. 5, 2019

(54) MEDICAL NEGATIVE-PRESSURE CHAMBER WITH MOVABLE TABLE

(71) Applicant: WEYERGANS HIGH CARE AG, Düren (DE)

(72) Inventor: Rudolf Weyergans, Düren (DE)

(73) Assignee: WEYERGANS HIGH CARE AG, Düren (DE)

( * ) Notice: Subject to any disclaimer, the term of this patent is extended or adjusted under 35 U.S.C. 154(b) by 626 days.

(21) Appl. No.: 14/892,801

(22) PCT Filed: Aug. 29, 2014

(86) PCT No.: PCT/EP2014/068381

§ 371 (c)(1),
(2) Date: Nov. 20, 2015

(87) PCT Pub. No.: WO2015/043878

PCT Pub. Date: Apr. 2, 2015

(65) Prior Publication Data

US 2016/0120735 A1 May 5, 2016

(30) Foreign Application Priority Data

Sep. 24, 2013 (EP) ..... 13185795

(51) Int. Cl.
*A61H 9/00* (2006.01)
*A61G 7/10* (2006.01)
*A61G 10/02* (2006.01)

(52) U.S. Cl.
CPC ..... *A61H 9/0057* (2013.01); *A61G 7/1034* (2013.01); *A61G 10/023* (2013.01);
(Continued)

(58) Field of Classification Search
CPC ..... A61H 9/00; A61H 9/005; A61H 9/0057; A61H 2201/0119; A61H 2201/0134;
(Continued)

(56) References Cited

U.S. PATENT DOCUMENTS 3,859,989 A 1/1975 Spielberg
4,805,626 A * 2/1989 DiMassimo ..... A61B 5/0555 269/20

(Continued)

FOREIGN PATENT DOCUMENTS

CN 1304325 A 7/2001
CN 1839780 A 10/2006

(Continued)

OTHER PUBLICATIONS

English translation of PCT International Preliminary Report on Patentability, dated Mar. 29, 2016, 7 pages.

(Continued)

*Primary Examiner* — Michael Tsai
*Assistant Examiner* — Jacqueline Pinderski
(74) *Attorney, Agent, or Firm* — Lucas & Mercanti, LLP

(57) ABSTRACT

A treatment device for medical and/or cosmetic therapy includes a negative-pressure chamber receiving a lower half of a person's body. The negative-pressure chamber is designed as a tube and has an admission opening sealed off from the person's body by a closure element. A first part of a table is arranged in the interior of the negative-pressure chamber. A second part of the table is arranged outside the negative-pressure chamber. The first part and the second part are each guided longitudinally on a linear guide. The first part can be moved at least partially out of the negative-pressure chamber and the second part can be moved away from the admission opening. A synchronization between the first part and the second part allows the first and second parts to be moved at the same speed in the same direction.

7 Claims, 5 Drawing Sheets

(52) U.S. Cl.
CPC ..... *A61H 9/005* (2013.01); *A61H 2201/1669* (2013.01); *A61H 2203/0443* (2013.01); *A61H 2203/0456* (2013.01); *A61H 2209/00* (2013.01)

(58) Field of Classification Search
CPC .... A61H 2201/0138; A61H 2201/0142; A61H 2201/146; A61H 2201/0149; A61H 2201/1669; A61H 2203/0443; A61H 2203/0456; A61H 2209/00; A61H 2201/1238; A61H 2201/16; A61G 7/08; A61G 7/10; A61G 7/1025; A61G 7/1034; A61G 10/023
USPC ..... 601/97, 98, 99, 100
See application file for complete search history.

(56) References Cited

U.S. PATENT DOCUMENTS

| | | | | | |
|---|---|---|---|---|---|
| 5,272,776 | A * | 12/1993 | Kitamura | A61B 5/0555 | 5/600 |
| 5,406,658 | A * | 4/1995 | Olkkonen | A61G 7/005 | 5/83.1 |
| 5,865,722 | A | 2/1999 | Heng | | |
| 2001/0003218 | A1 * | 6/2001 | Schaefer | A61B 6/0457 | 5/601 |
| 2001/0029330 | A1 * | 10/2001 | Nose | A61B 5/0555 | 600/410 |
| 2005/0060804 | A1 * | 3/2005 | Heinl | A61B 5/0555 | 5/601 |
| 2008/0132813 | A1 * | 6/2008 | Katsuta | A61H 1/005 | 601/49 |
| 2016/0242993 | A1 | 8/2016 | Whalen et al. | | |

FOREIGN PATENT DOCUMENTS

| | | | | |
|---|---|---|---|---|
| CN | 101896152 | A | 11/2010 | |
| CN | 102319175 | A | 1/2012 | |
| CN | 202236221 | * | 5/2012 | A61H 33/06 |
| CN | 202236221 | U | 5/2012 | |
| DE | 19912611 | A1 | 9/2000 | |
| EP | 0008719 | A1 | 3/1980 | |
| EP | 1002510 | A1 | 5/2000 | |
| EP | 1656921 | A1 | 5/2006 | |

OTHER PUBLICATIONS

European Patent Office, Notice of Opposition to a European patent, Oct. 6, 2016, 34 pgs. (opposition of corresponding European patent application).
Toshimi, News article of Toshimi website of May 28, 2012, Toshimi website, May 28, 2012, 5 pgs.
Toshimi, English (machine-)translation of cite No. 2, Toshimi website, May 28, 2012, 2 pgs.
Toshimi, News article of Toshimi website of May 29, 2012, Toshimi website, May 29, 2012, 2 pgs.
Toshimi, English (machine-)translation of cite No. 4, Toshimi website, May 29, 2012, 2 pgs.
Toshimi, Brochure 1 of the Toshimi VF-2 device (Jan. 24, 2013), Toshimi, Jan. 24, 2013, 4 pgs.
Toshimi, Brochure 2 of the Toshimi VF-2 device (Apr. 19, 2013), Toshimi, Apr. 19, 2013, 2 pgs.
Toshimi, News article of Toshimi website of Jun. 5, 2013 (Jun. 5, 2013), Toshimi website, Jun. 5, 2013, 3 pgs.
Toshimi, English (machine-)translation of cite No. 8, Toshimi website, Jun. 5, 2013, 6 pgs.
Toshimi, Product page Toshimi website (May 16, 2013), Toshimi website, May 16, 2013, 2 pgs.
Weyergans High Care AG, Vacumed website pages before priority date of the patent, Weyergans High Care AG, 2012, 5 pgs.

* cited by examiner

MEDICAL NEGATIVE-PRESSURE CHAMBER WITH MOVABLE TABLE

CROSS-REFERENCE TO RELATED APPLICATIONS

This application is a 371 of PCT/EP2014/068381 filed Aug. 29, 2014, which in turn claims the priority of EP 13185795.5 filed Sep. 24, 2013, the priority of both applications is hereby claimed and both applications are incorporated herein by reference.

BACKGROUND OF THE INVENTION

The invention pertains to a treatment device with a negative-pressure chamber for accommodating the lower half of the body of a person, wherein the negative-pressure chamber comprises an entrance opening, which can be sealed off gas-tight against the trunk of the person by means of a sealing element, the treatment device having a table with a first part, arranged in the negative-pressure chamber, adapted to support the lower half of the body and a second part, arranged outside the negative-pressure chamber as an extension of the first part, to support the upper half of the body of the person, and between the first part and the second part an interruption is arranged, through which the sealing element can be brought into contact with the trunk of the person.

Such treatment devices with negative-pressure chambers for medical and/or cosmetic/physical therapy are known from EP 1 002 510 B1. They serve to enclose the lower half of the body of a person and to subject it to a defined, pulsating negative pressure. The pulsating negative pressure has the effect of stimulating blood circulation and of relieving the congestion of the lymphatic vessels.

The negative-pressure chamber, which is designed as a hollow cylinder, comprises an entrance opening at one end, which is sealed off against the trunk by a sealing element. A sealing element disclosed in DE 199 12 611 C2 comprises a flexible tube made of almost completely gas-impermeable material, one end of this tube being fastened to the negative-pressure chamber. By means of a ring attached to the other end of the tube, the tube is twisted until it rests tightly against the trunk.

A first part of a table is arranged in the interior of the horizontally oriented negative-pressure chamber. A second part of the table is arranged outside the negative-pressure chamber as an extension of the first part. Between the first and second parts, an interruption is provided, through which the sealing element can be brought into contact with the trunk of the person.

The therapy of patients with only limited mobility in such negative-pressure chambers can cause problems because of the difficulty of entering the negative-pressure chamber through the vertical entrance opening. Especially in the case of patients with no mobility at all, introducing the lower half of the body through the vertical entrance opening into the horizontally oriented negative-pressure chamber is almost impossible.

BRIEF SUMMARY OF THE INVENTION

An object of the invention is to create a treatment device with a negative-pressure chamber for medical and/or cosmetic/physical therapy which can also be used easily in particular by patients with limited mobility.

This object is achieved with a treatment device of the type with the table mentioned above in that both the first part and the second part of the table are each guided on a linear guide so as to move longitudinally in the same direction, wherein the first part can be moved at least partially out of the negative-pressure chamber and the second part can be moved away from the entrance opening, and the treatment device comprises a system for synchronizing the first part and the second, which is set up in such a way that it causes the first and second parts to move in the same direction at the same speed.

The split table can be moved out of its base position into a receiving position, in which the table is almost completely outside the negative-pressure chamber. In this receiving position, even a person with limited mobility, in particular a person whose body is in a fully stretched-out position, can be laid on the table. Then the table is pushed back into the base position, wherein the first part of the table, on which the lower half of the person's body is resting, arrives in the negative-pressure chamber through the entrance opening.

The synchronization of the first and second parts of the table has the effect that no relative movement occurs between the two parts during the time that they are being pushed into the base position for the performance of the negative-pressure treatment. The relatively narrow interruption between the first and second parts does not interfere with the comfort of the person lying on the table. Especially when the sealing element according to DE 199 12 611 C2 comprises a flexible tube, which can be brought into contact with the trunk of the person by twisting, the first and second parts of the table can be arranged at a distance of only a few centimeters from each other, wherein the tube can be brought into contact with the trunk of the person through the relatively narrow gap.

The two-part table can be moved by hand or preferably by means of a drive out of the base position into the receiving position and back again along the path defined by the linear guide. The linear guide for the table is preferably configured as a roller guide to reduce the forces necessary to move the table; it comprises profiled sections, in which the rollers of a rolling slide can roll. The rolling slide comprises rollers, which are distributed in the longitudinal direction of the path of movement in correspondence with the load exerted on the table, wherein preferably the rollers which are in the outer lower positions when in the installation position absorb the weight, whereas the middle roller, which is offset upwards, prevents the table connected to the rolling slide from tilting in the profiled sections.

The drive which moves the table is implemented in particular as a self-retaining linear drive such as a spindle. Because the drive is self-retaining, the table is effectively held in place after the drive has been turned off, and thus any unintended movement is prevented and there is no need for an additional braking device.

To avoid injury which might be caused to the person by the movable table, a safety clutch is arranged between the drive and the table to interrupt the flow of force from the drive to the driven table whenever a certain drive force is exceeded. The safety clutch preferably comprises at least one elastically deformable clutch element, which engages in a receiving opening in the other, cooperating part of the two connected parts. The elastically deformable clutch element is preferably configured as a conically tapering elastic peg, which engages in a receiving opening. When the forces introduced into the safety clutch in the direction of the path in which the table travels exceed a certain value, the conical elastic peg slides out of the receiving opening and interrupts the flow of force between the drive and the table.

A switch element is preferably arranged at each receiving opening for an elastic clutch element, especially a clutch element in the form of a peg; the switch element can be in the form of a light barrier, for example, or a pushbutton switch. On the basis of the electrical signal produced by the switch element when the clutch engages, the switch element makes it is possible to confirm that the safety clutch has been properly engaged during the assembly of the table. In addition, the switch element also cuts off the power supply to the drive as soon as the safety clutch responds.

The synchronization of the first and second parts of the table is preferably achieved by means of two separate drives, especially by a first linear drive for the first part and a second linear drive for the second part, wherein the drives are controlled in such a way that they move the first and second parts at the same speed in the same direction.

Alternatively, the synchronization of the first and second parts of the table can be achieved by a mechanical connection of the two parts, which temporarily connects the first and second parts to each other. To seal the negative-pressure chamber after the first part of the table and thus the lower half of the body of the person have completely entered the chamber, the connection between the first and second parts must be disengaged. If, according to this embodiment of the invention, the first and second parts are connected mechanically while they are being moved, only one drive is necessary to move the entire table.

BRIEF DESCRIPTION OF THE DRAWINGS

The invention is explained in greater detail below on the basis of an exemplary embodiment.

DETAILED DESCRIPTION OF THE PREFERRED EMBODIMENTS

Figure 1:
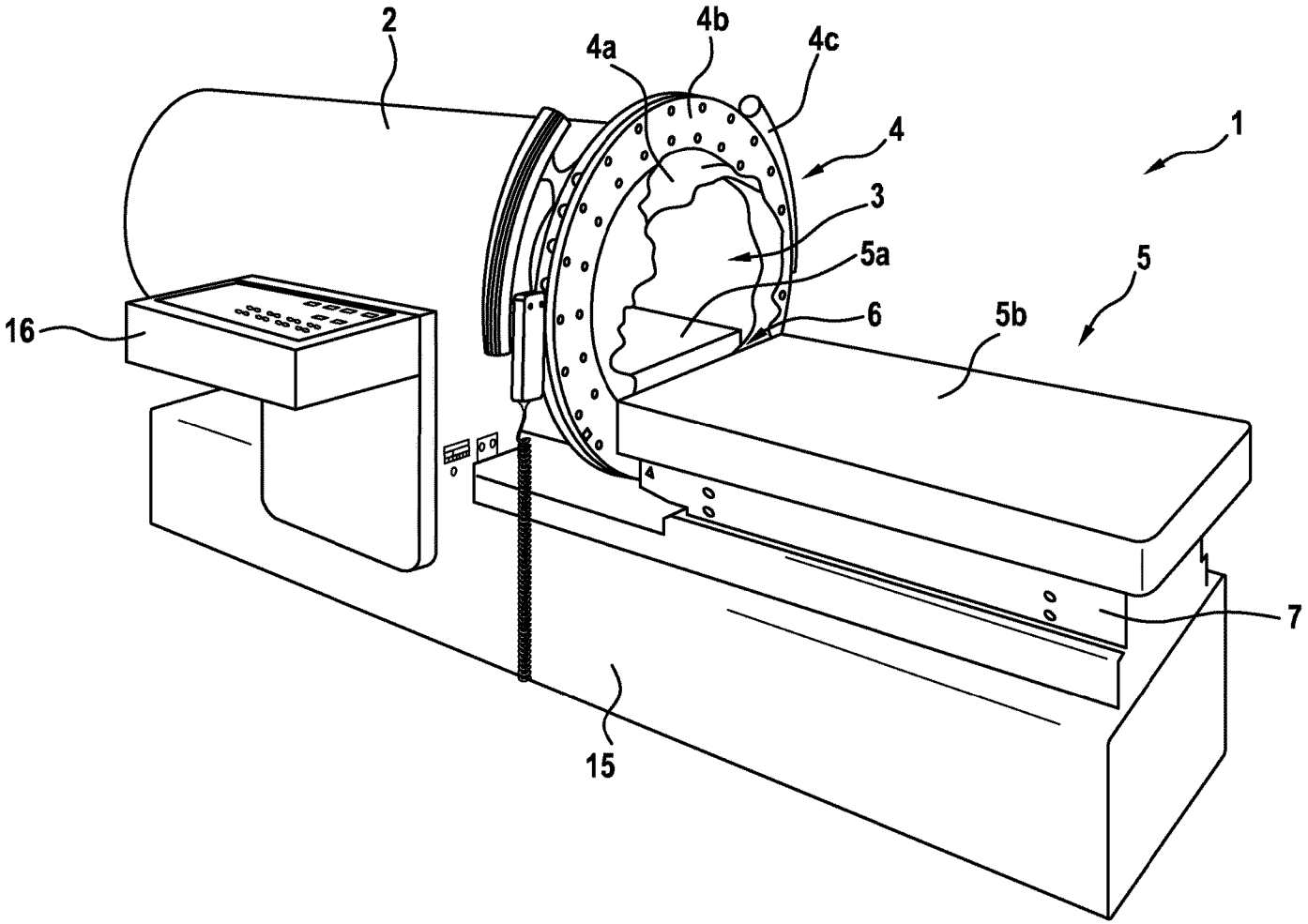
FIG. 1 shows a perspective view of a treatment device according to the invention with a table in the base position.

FIG. 1 shows a treatment device 1 with an elongated, hollow, cylindrical negative-pressure chamber 2 for accommodating the lower half of the body of a person (not shown for the sake of clarity) to be treated. At one of the two ends of the negative-pressure chamber there is an entrance opening 3, which can be sealed off gas-tight against the trunk of the person to be treated. The sealing element 4 comprises a flexible tube 4*a* of almost completely gas-impermeable material, which is fastened at one end to the entrance opening 3 and at the other end to a rotation ring 4*b*. Rotation grips 4*c* are attached to the outer edge of the rotation ring. To seal off the negative-pressure chamber 2 against the trunk of the person in a gas-tight manner, the tube surrounds the trunk of the person to be treated. By rotating the tube by means of the rotation ring 4*b*, the tube is twisted, as a result of which the tube becomes tightly wrapped around the trunk.

The negative-pressure chamber 2 is connected to a negative-pressure generator (not shown), in particular a vacuum pump. The negative-pressure chamber comprises means for generating a negative-pressure profile. These means comprise in particular a control unit for setting the length of time during which the negative-pressure generator is activated and possibly for controlling its operating level. Finally, the means comprise at least one actuatable venting valve for the negative-pressure chamber. These means can be used to produce a negative-pressure profile, in which the pressure in the negative-pressure chamber is lowered by a maximum of 80 mbars versus atmospheric, ambient pressure and alternates between the lowered pressure and atmospheric pressure. Alternatively, the pressure in the negative-pressure chamber is lowered by 35-80 mbars versus the atmospheric, ambient pressure and then increased by 20-60 mbars. As a result, the negative pressure in the first negative-pressure chamber alternates between a first, higher, negative-pressure value and a second, lower, negative-pressure value.

The negative-pressure chamber 2 is mounted on a stand 15 of the treatment device 1. A control panel 16 for the treatment device is also mounted on the stand 15.

The treatment device 1 also comprises a horizontally oriented table 5 with a first part 5*a* arranged inside the negative-pressure chamber 2 when in the base position and a second part 5*b*, which forms an extension of the first part 5*a* and is arranged outside the negative-pressure chamber 2 when in the base position.

The first part 5*a* has such a length and such a width that it is adapted to support the lower half of the body of the person to be treated. The second part 5*b* has such a length and such a width that it is adapted to support the upper half of the person to be treated. Between the first part 5*a* and the second part 5*b* of the table 5 is an interruption 6, especially easy to see in FIG. 2, in the form of a gap dividing the table 5 transversely to the lengthwise direction. In the base position shown in FIG. 1, the tube 4*a* of the sealing element 4 passes through the gap and is arranged on the person to be treated so that it rests flush on the trunk.

Figure 2:
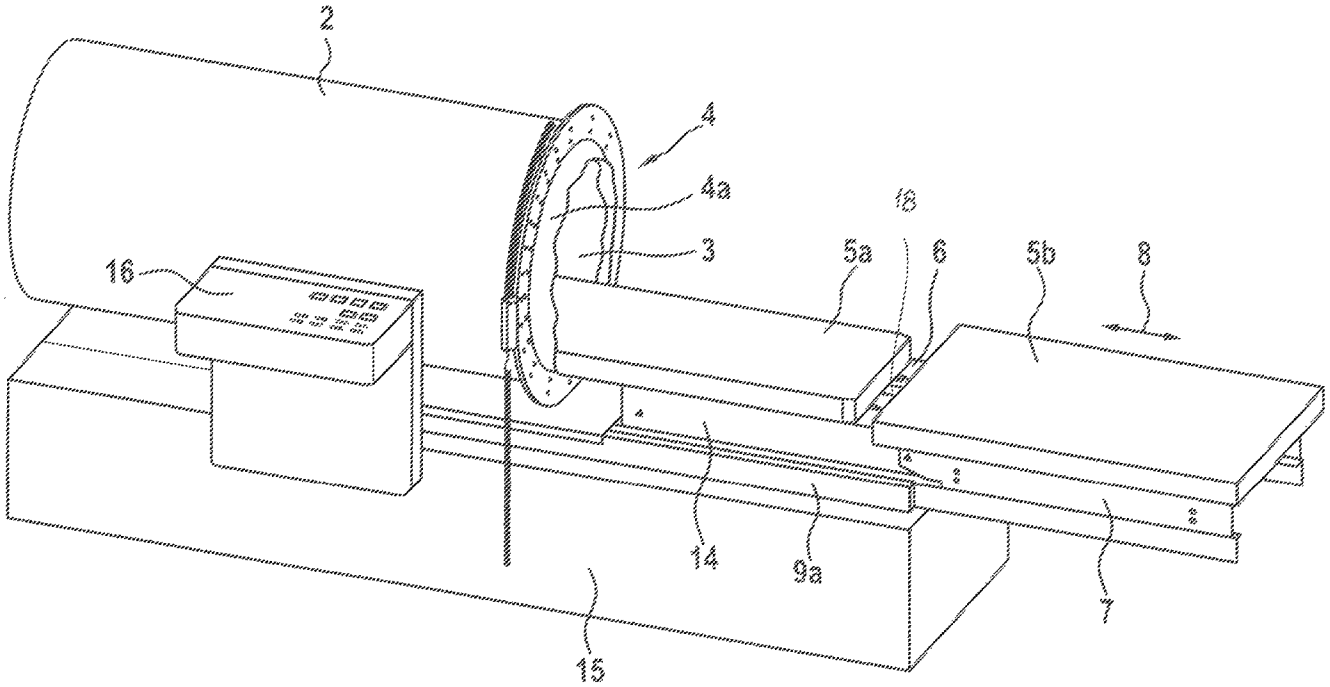
FIG. 2 shows the treatment device according to FIG. 1 with the table in the receiving position.

Both the first part 5*a* and the second part 5*b* of the table 5 are guided so as to move in the same longitudinal direction, wherein the first part 5*a* can be moved at least partially out of the base position shown in FIG. 1 and thus out of the negative-pressure chamber 2, and the second part 5*b* can be moved away from the entrance opening 3, as shown in FIG. 2. FIG. 2 shows the table 5 in its receiving position, in which a person with limited mobility can be easily laid on the table 5.

The structure of the linear guide 7 is explained in greater detail below on the basis of FIGS. 3 and 4. The linear guide 7 is implemented as a roller guide and comprises guide sections 9*a*, 9*b* extending in the direction of the path 8 along which the table moves; rollers 10 of a rolling slide 11 roll along these guide sections. The rolling slide 11 consists of two longitudinal bars 11*a*, 11*b*, extending parallel to the guide sections 9*a*, 9*b*; these bars are connected to each other by several transverse bars 11*c*. The second part 5*b* of the table is screwed to the horizontally extending sections of the transverse bars 11*c* which are at the rear with respect to the insertion direction. The rollers 10 are rotatably supported on the sections of the longitudinal bars 11*a*, 11*b* which are in the front with respect to the insertion direction, so that the second part 5*b* of the table 5 can be pulled out as if it were a drawer. The rollers 10 are rotatably supported on the longitudinal bars 11*a*, 11*b* of the rolling slide 11 with an offset in the longitudinal direction of the longitudinal path 8, wherein the two rollers on each side of the rolling slide 11 which are in the lower position when in the installation position absorb the weight of the person lying on the second part 5*b* of the table 5, and at least one roller, shifted vertically upward, on each side of the rolling slide 11 prevents the rolling slide from tipping in the guide sections 9*a*, 9*b*.

Figure 5:
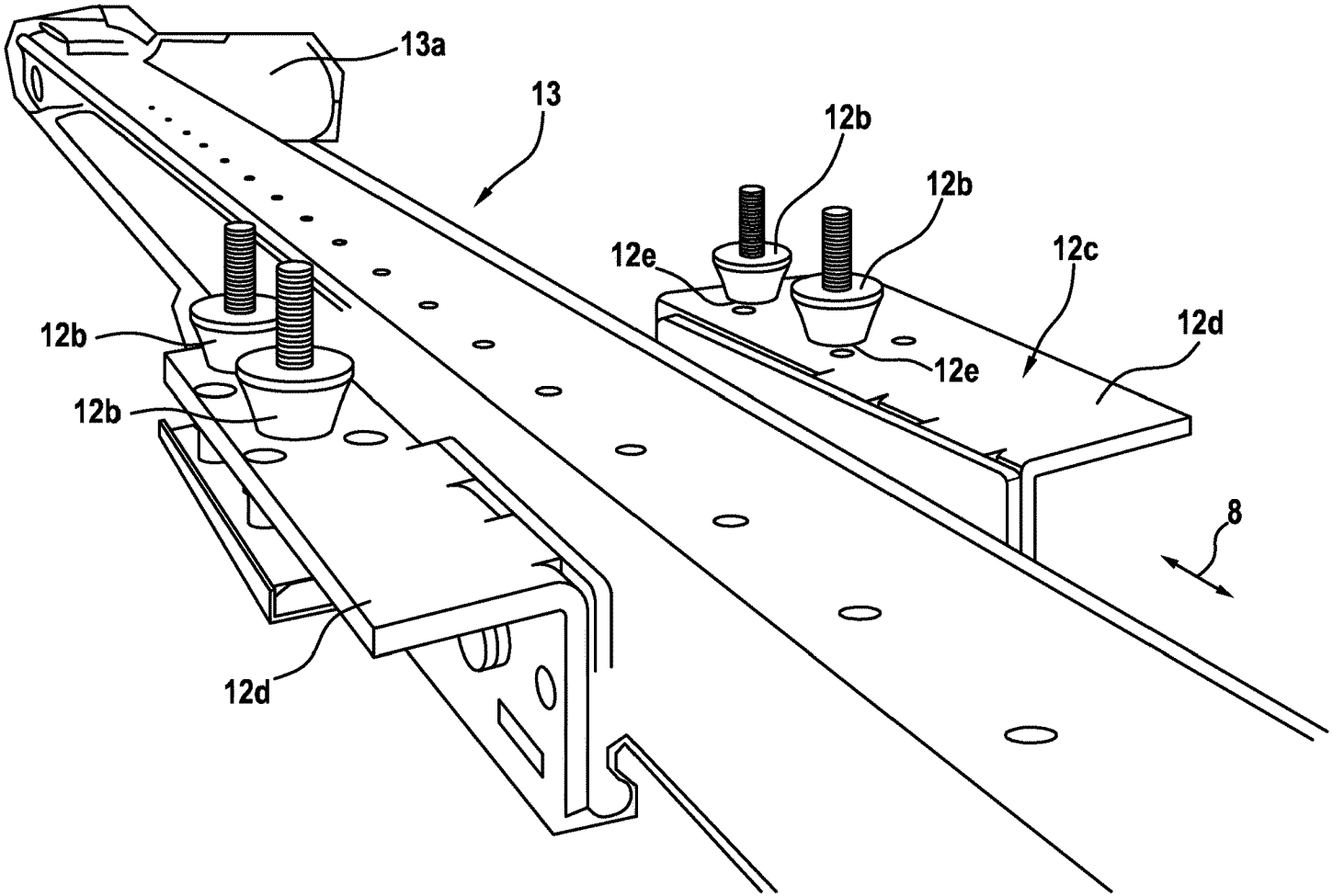
FIG. 5 shows a perspective view of a drive for the table.

A clutch plate 12*a* of a safety clutch 12, which is oriented horizontally when in the installation position, is provided on the transverse bar 11*c* which is at the front with respect to the insertion direction. The safety clutch 12 connects the rolling slide 11 to a linear drive 13, shown overall in FIG. 5, for moving the second part 5*b* of the table 5 along the path 8 defined by the linear guide 7. The safety clutch 12 comprises four elastically deformable clutch elements 12*b*, which are configured as conically tapering pegs of elastic material. The downward-pointing tips of the pegs project vertically downward from the clutch plate 12*a*.

The linear drive 13 comprises a drive motor 13*a*, which, by means of a spindle (not shown), moves a U-shaped second clutch component 12*c* back and forth in the direction of the path 8. The clutch component 12*c* comprises two horizontal sections 12*d*, which are located on the same horizontal plane in alignment with each other. In each of the two horizontal sections 12*d*, two receiving openings 12*e* are provided, which are arranged one behind the other in the direction of the path 8. The distance between these openings corresponds to the distance between the clutch elements 12*b*, so that these elements can engage from above in the receiving openings 12*e* and thus allow forces to flow between the linear drive 13 and the rolling slide 11.

When the drive force transmitted by the linear drive 13 by way of the clutch elements 12*b* in the direction of the path 8 exceeds a certain value determined by the structural design of the safety clutch 12, the clutch elements 12*b* slip out of the receiving openings 12*e* and cut off the flow of force between the linear drive 13 and the rolling slide 11.

The first part 5*a* of the table 5 is also guided by a linear guide of similar design and can move back and forth in the direction of the path 8 from the base position into the receiving position and from the receiving position back into the base position by means a separate linear drive. In addition, the second part 5*b* is also connected by a safety clutch to its own linear drive. The structure of the safety clutch is the same as that of the safety clutch for the second part 5*b* of the table 5, so that reference can be made to the description given above.

Figure 3:
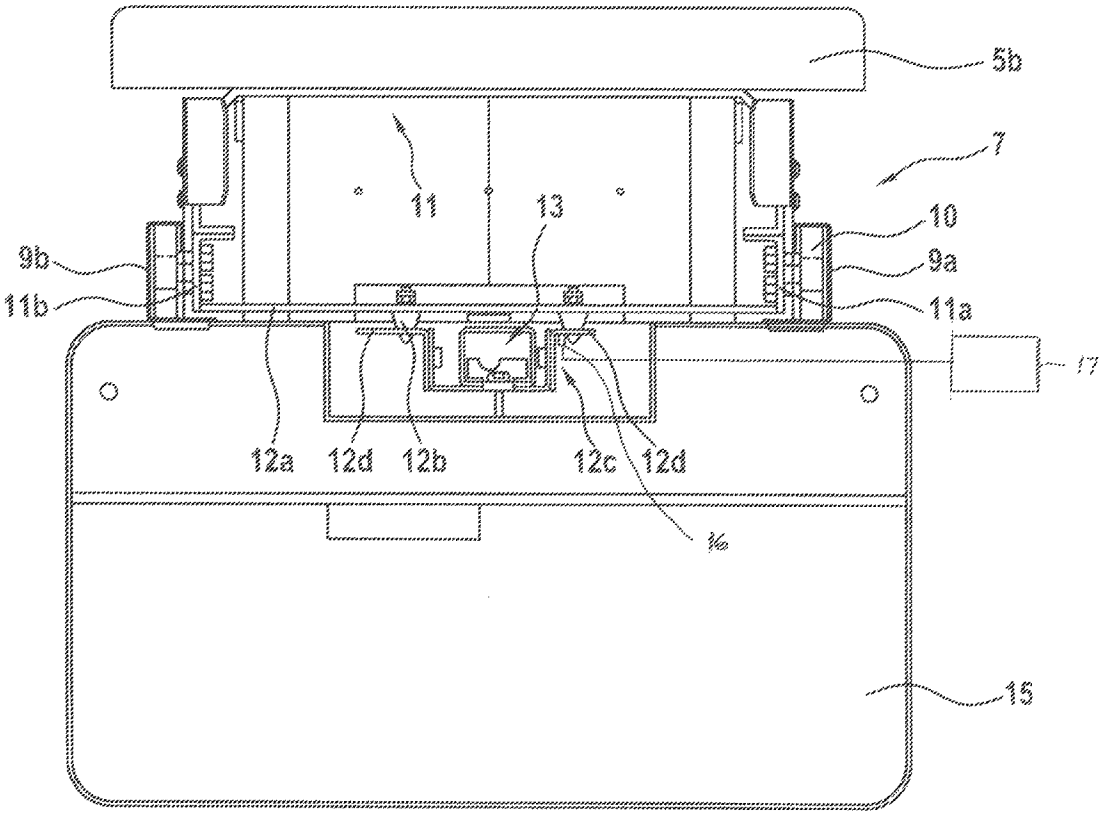
FIG. 3 shows a front view of the treatment device according to FIGS. 1 and 2.
Figure 4:
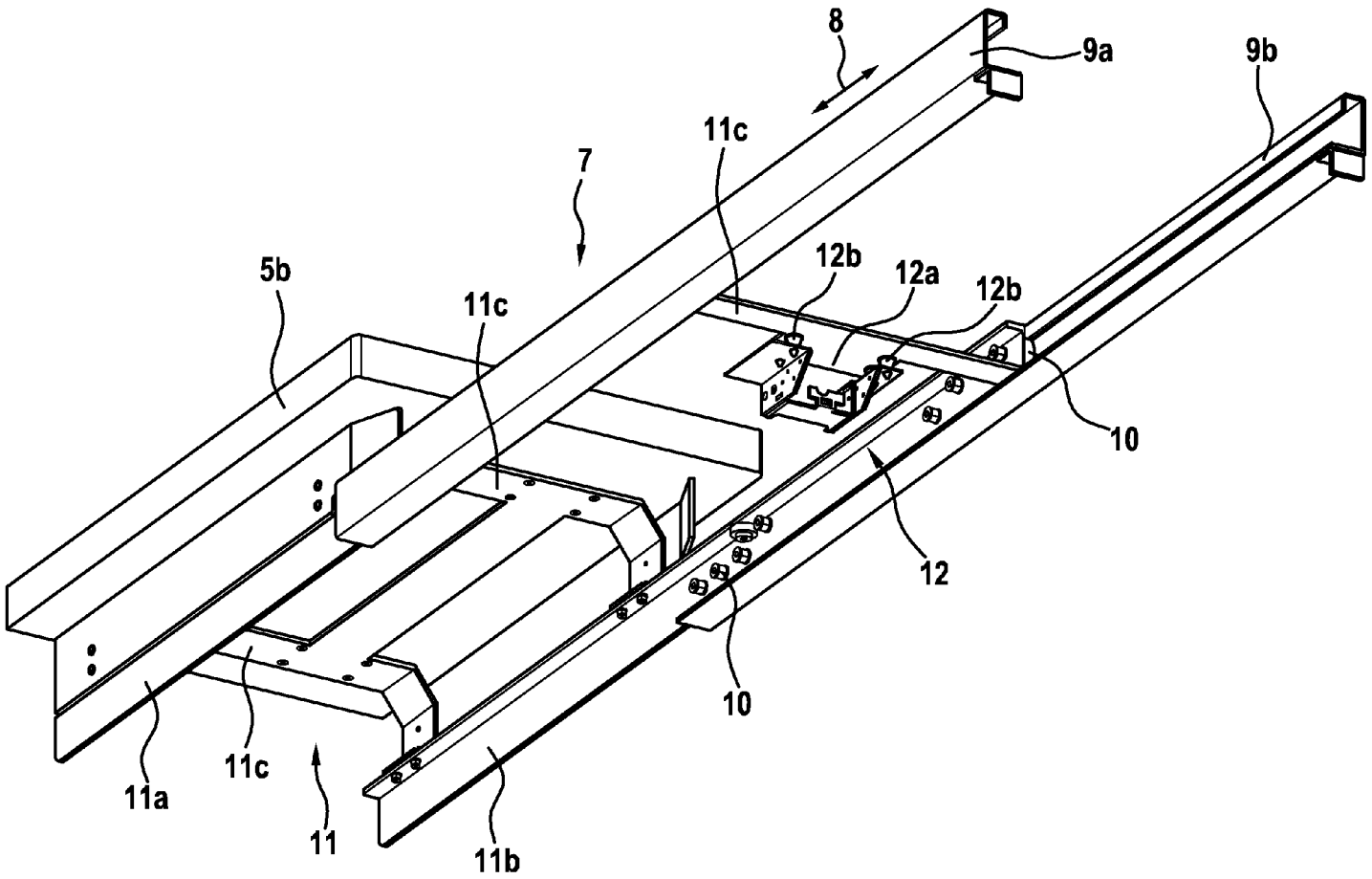
FIG. 4 shows a perspective view, from below, of the second part of the table.

As shown in FIG. 3, a switch element 16 is arranged at each receiving opening 12*e* (only one element is shown in FIG. 3). The switch 16 is connected to a circuit 17, and on the basis of the electrical signal produced by the switch element when the clutch engages, the switch element 16 makes it is possible to confirm that the safety clutch has been properly engaged during the assembly of the lying surface. In addition, the switch element 16 also cuts off the power supply to the drive as soon as the safety clutch responds.

The two linear drives 13 for the first and second parts 5*a*, 5*b* of the table 5 are synchronized with each other by a control system in such a way that the two linear drives 13 move the first and second parts of the table 5 at the same speed and in the same direction. As a result of the synchronous movement of the first and second parts 5*a*, 5*b* of the table 5, the size of the interruption 6 does not change, and thus the comfort of the person to be treated is not impaired during the movement of the table from the base position into the receiving position or vice versa.

Alternatively, the synchronization of the first and second parts of the lying surface can be achieved by a mechanical connection 18 of the two parts (shown schematically in FIG. 2), which temporarily connects the first and second parts of the lying surface to each other.

In the receiving position shown in FIG. 2, the section of the first part 5*a* of the table 5 projecting beyond the longitudinal bars is supported on a guide table 14 in order to reduce the bending moments in the guide sections (not shown) for the first part 5*a* of the table.

List of Reference Symbols

| No. | Name |
|---|---|
| 1 | treatment device |
| 2 | negative-pressure chamber |
| 3 | entrance opening |
| 4 | sealing element |
| 4a | tube |
| 4b | rotation ring |
| 4c | rotation grips |
| 5 | table |
| 5a | first part |
| 5b | second part |
| 6 | interruption |
| 7 | linearguide |
| 8 | path of movement |
| 9a, b | guide sections |
| 10 | rollers |
| 11 | rolling slide |
| 11a, b | longitudinal bars |
| 11c | transverse bar |
| 12 | safety clutch |
| 12a | clutch plate |
| 12b | clutch elements |
| 12c | clutch component |
| 12d | horizontal section |
| 12e | receiving openings |
| 13 | linear drive |
| 13a | drive motor |
| 14 | guide table |
| 15 | base frame |

The invention claimed is:

1. A treatment device, comprising:

a negative-pressure chamber for accommodating a lower half of a body of a person, the negative pressure chamber having an entrance opening;

a sealing element configured to provide a gas-tight seal between the entrance opening and a trunk of the person;

a table with a first part arranged in the negative-pressure chamber and adapted to support the lower half of the body and a second part arranged outside the negative-pressure chamber as an extension of the first part and adapted to support the upper half of the body of the person; and an interruption is provided between the first part and the second part of the table, the sealing element passes through the interruption and is arrangeable to contact the trunk of the person;

a linear guide on which both the first part and the second part of the table are each guided longitudinally in a same direction, such that the first part is movable at least partially out of the negative-pressure chamber and the second part is movable away from the entrance opening;

a synchronizing device synchronizing the first part and the second part of the table, the synchronizing device being configured to move the first part and the second part of the table in the same direction at a same speed along the liner guide, the synchronizing device including at least one drive configured to move the table along the linear guides, and a safety clutch between each said at least one drive and the table, each safety clutch interrupting a flow of force between said at least one drive and a driven part of the table when a drive force limit is exceeded.

2. The treatment device according to claim 1, wherein the linear guide is configured as a roller guide.

3. The treatment device according to claim 1, wherein each said at least one drive is a self-retaining drive.

4. The treatment device according to claim 1, wherein each said safety clutch comprises a first elastically deformable clutch element engaging a receiving opening in a second clutch element.

5. The treatment device according to claim 4, wherein a switch element is arranged at each receiving opening, which, upon engagement of the first elastically deformable clutch element in the receiving opening, completes a circuit.

6. The treatment device according to claim 1, wherein the synchronizing device comprises at least one first drive for the first part and at least one second drive for the second part of the table, the at least one first drive and the at least one second drive being controlled such that the first part and the second part of the table move at the same speed and in the same direction.

7. The treatment device according to claim 1, wherein the synchronizing device comprises a mechanical connection that temporarily connects the first and second parts of the table.

* * * * *